US007721783B2

(12) United States Patent
Colson et al.

(10) Patent No.: US 7,721,783 B2
(45) Date of Patent: May 25, 2010

(54) HORIZONTALLY SLATTED BLIND

(75) Inventors: Wendell B. Colson, Weston, MA (US); Daniel M. Fogarty, Framingham, MA (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 146 days.

(21) Appl. No.: 11/823,901

(22) Filed: Jun. 29, 2007

(65) Prior Publication Data

US 2008/0000593 A1 Jan. 3, 2008

Related U.S. Application Data

(60) Provisional application No. 60/818,118, filed on Jun. 30, 2006.

(51) Int. Cl.
*E06B 9/26* (2006.01)
*E06B 9/303* (2006.01)

(52) U.S. Cl. ..... 160/176.1 R; 160/174

(58) Field of Classification Search ..... 160/131, 160/166.1, 174 R, 178.1 R, 176.1 R, 177 R, 160/178.3, 236, 218, 900; 49/74.1, 86.1
See application file for complete search history.

(56) References Cited

U.S. PATENT DOCUMENTS

| | | | | |
|---|---|---|---|---|
| 2,521,151 | A * | 9/1950 | Cusick | 160/168.1 R |
| 2,625,220 | A * | 1/1953 | Ferreira | 160/172 R |
| 4,187,897 | A * | 2/1980 | Frentzel | 160/177 R |
| 5,165,459 | A * | 11/1992 | Gaber et al. | 160/168.1 R |
| 5,375,642 | A * | 12/1994 | Gaber et al. | 160/168.1 R |
| 5,501,261 | A * | 3/1996 | Peale | 160/168.1 R |
| 5,595,231 | A * | 1/1997 | Marocco | 160/168.1 R |
| 6,318,441 | B1 * | 11/2001 | Love et al. | 160/236 |
| 6,405,783 | B1 * | 6/2002 | Smith | 160/176.1 R |
| 2002/0079065 | A1 * | 6/2002 | Smith | 160/176.1 R |
| 2005/0022947 | A1 * | 2/2005 | Yu et al. | 160/174 R |

* cited by examiner

*Primary Examiner*—Katherine W Mitchell
*Assistant Examiner*—Jeremy C Ramsey
(74) *Attorney, Agent, or Firm*—Day Pitney LLP

(57) ABSTRACT

A horizontally slatted blind for an opening, such as a window, has a plurality of slats suspended from points on their two ends. One such point is the rear corner, and the other is between the front and rear corners. The edges of the slats between the rear corners are provided with stiffeners, which makes the slats rigid and provides them with additional weight. The axes of rotation of the slats lies between the points of suspension, and the slats are balanced relative thereto because of the extra weight provided by the stiffeners.

28 Claims, 15 Drawing Sheets

HORIZONTALLY SLATTED BLIND

CROSS-REFERENCE TO RELATED APPLICATIONS

This is a nonprovisional application having a claim for priority based on U.S. Patent Application Ser. No. 60/818,118, filed Jun. 30, 2006.

BACKGROUND OF THE INVENTION

1. Field of the Invention

The present invention relates generally to horizontally slatted blinds, that is, to Venetian blinds, and more particularly to blinds of this general type having slats which are cantilevered.

2. Description of the Relevant Art

Venetian blinds, of course, are well-known in the art. Indeed, they are ubiquitous and can be found in homes and offices around the world.

Cantilevered blinds of this general type have slats which turn, to open or close the blind, about axes which do not coincide with the centers of the slats. The axes, instead, are typically closer to the opening, such as a window, than the geometric centers of the slats so that, when the blind is closed, the slats will be close to the window or opening.

The relevant art includes several examples of this general type of blind. U.S. Pat. No. 1,590,886 to Carella, for example, shows a window blind having spaced vertically disposed chains having their opposite ends secured to the top and bottom of the window frame. Slats are mounted one above the other on the chains, pivoting about the chain links to which they are attached. A cable, attached to each of the slats, is used to open or close the blind. This blind, however, has no means for being raised or lowered as a whole. Whether opened or closed, the blind always extends for the full height of the window because the chains are secured to the top and bottom of the frame.

U.S. Pat. No. 2,583,449 to Tarnoff shows an elaborate Venetian blind having slats cantilevered in front of a mechanical linkage which collapses as the blind is raised from its bottom. The slats may be opened or closed by turning the rod from which the mechanical linkage is suspended. The slats themselves are entirely free of tapes and cords, and may be easily cleaned.

U.S. Pat. No. 5,165,459 to Gaber et al. shows a window covering having a head rail and a plurality of slats suspended therefrom. The slats are adapted to pivot and thereby contact contiguous slats to form dead air cells for improved appearance and insulating properties. The cords which raise and lower the window covering and which open and close the slats pass through holes therein. The slats may be pivoted in a cantilevered manner, that is, they may be pivoted about an axis not coincident with their centers, by providing opposite sides of the slats with different weight.

Finally, U.S. Pat. Nos. 6,405,783 and 6,557,615 to Smith, which patents are related to one another, show a horizontal window blind apparatus having slats which are cantilevered outward from tabs. The tabs are raised, lowered and tilted in a manner similar to that employed in a conventional Venetian blind.

Notwithstanding these cantilevered blinds of the relevant art, there remains a need for a horizontally slatted blind having slats which are wider than those customarily used in Venetian blinds. There further remains a need for such a blind whose slats have no holes through which light would be able to leak from outside into a room. Moreover, there remains a need for a blind which will hang closely adjacent to a window when closed, so that light will be less able to pass around its ends into a room. These needs are met by the present invention.

SUMMARY OF THE INVENTION

Accordingly, the present invention is a horizontally slatted blind which is designed to hang in close proximity to a window when closed. The blind comprises a header for mounting the blind across an opening. Mounted within the header is a rod which extends longitudinally therein. The rod has a first and second end and a longitudinal axis, and is rotatable about its longitudinal axis.

A plurality of slats is disposed horizontally and spaced vertically below the header. Each slat in the plurality of slats has a first end and a second end, a front corner at each of the first and second ends and a rear corner at each of the first and second ends. Each slat also has a stiffener which extends substantially from the rear corner at its first end to the rear corner at its second end.

First tilt cords and second tilt cords are attached to and extend from each of the first and second ends of the rod. The first tilt cords are attached to the first and second ends of the slats at points between their front and rear corners and the second tilt cords are attached to the first and second ends of the slats substantially at the rear corners. This places the axis of rotation of each slat at a point between the attachment points for the first and second tilt cords, namely, more toward the rear, or window, from where the axis of rotation would be if geometrically centered. As a consequence, the closed blind will be closer to the window than a conventional blind.

The stiffeners are provided for two reasons. Firstly, since the axes of rotation are closer to the rear of the slats than to the front, the stiffeners act as counterweights to the wider portions of the slats on the other side of the axes of rotation, thereby enabling each slat to be balanced about its axis of rotation. Secondly, since each slat may only be suspended from points on its first and second ends, the stiffeners are provided to prevent them from sagging below the first and second ends.

Finally, the blind comprises means for attaching the first and second tilt cords to the first and second ends of the rod whereby, when the rod is rotated about its longitudinal axis, one of the first and second tilt cords is lowered while the other of the first and second tilt cords is raised by an equal amount, so that the plurality of slats open or close in unison.

The present invention will now be described in more complete detail with frequent reference being made to the accompanying drawings, which are identified below.

DETAILED DESCRIPTION OF THE PREFERRED EMBODIMENTS

Before describing the present invention in more particular detail, it will be useful to illustrate its basic rationale. The present invention provides a blind with slats which are generally wider than the norm, perhaps as wide as 3.5 inches or more. The present invention additionally provides a blind whose slats lack the holes normally required for ladder and lift cords, as these cords are disposed at the ends of the slats. In other words, when the blind is closed, light cannot leak through the slats into the room.

Figure 1A:
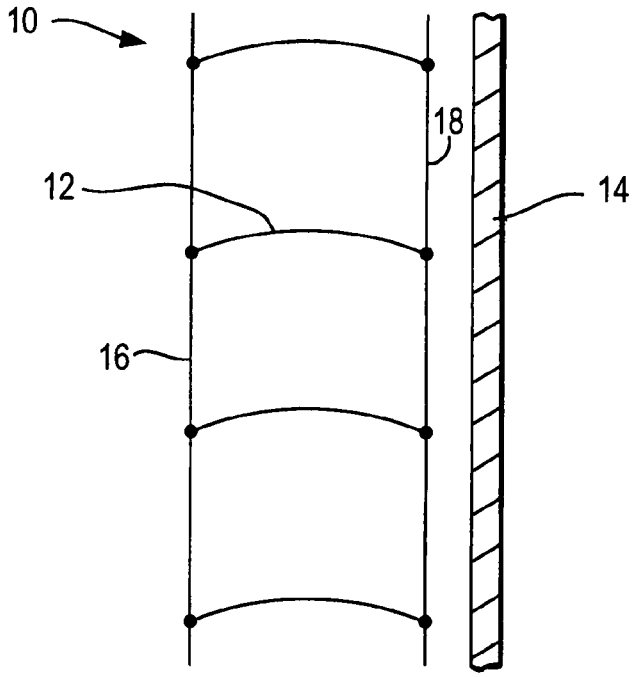
FIG. 1A is an end view of several slats in an open hypothetical horizontally slatted blind.

Referring now to FIG. 1A, which is an end view of several slats 12 in a hypothetical horizontally slatted blind 10 in front of a window 14, tilt cords 16, 18 are attached to the corners of the ends of the slats 12. When the blind 10 is open, as shown in FIG. 1A, the slats 12 are relatively close to the window 14.

Figure 1B:
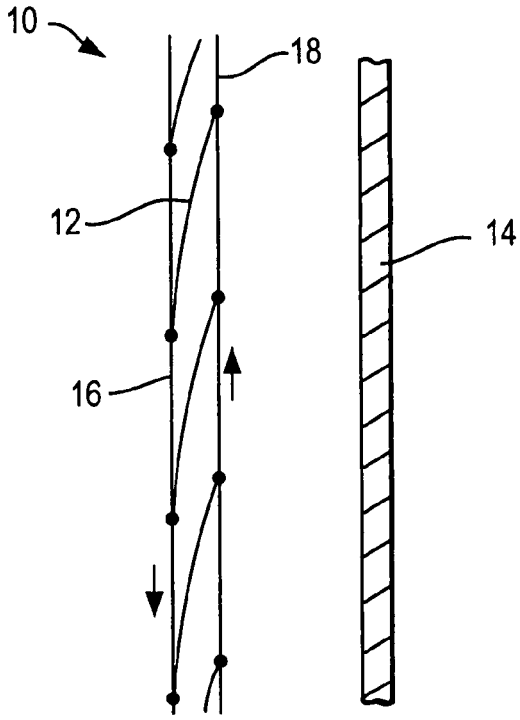
FIG. 1B is an end view of the blind shown in FIG. 1A when closed.

When blind 10 is to be closed, the customarily used mechanism simultaneously lowers tilt cord 16 and raises tilt cord 18, or vice versa, turning each slat 12 about an axis of rotation which generally coincides with the center of the width of each. FIG. 1B, an end view of the slats 12 when the blind 10 has been closed, the tilt cord 16 having been moved in a downward direction and the tilt cord 18 having been moved in an upward direction, as indicated by the arrows, shows that the slats 12 are considerably farther from the window 14 when the blind 10 is closed than it is when open. In such a situation, light from outside the window 14 is better able to pass into the room from around the ends of the slats 12 than it would if it were possible for the closed blind 10 to be closer to the window 14.

The present invention provides a solution to this problem by moving the axes of rotation of the slats closer to the window 14 so that, when the blind 10 is closed, the slats 12 remain substantially as close to the window 14 as they are when the blind 10 is open.

Figure 2A:
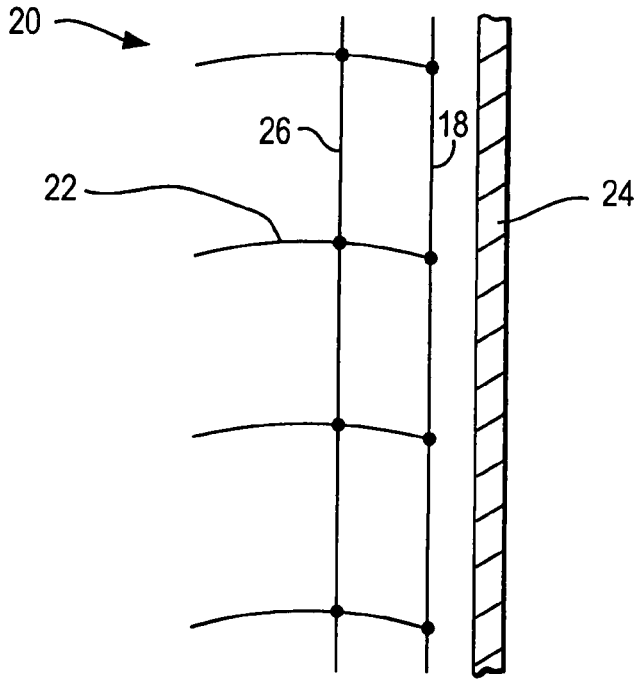
FIG. 2A is an end view of several slats in another open hypothetical horizontally slatted blind.

Referring to FIG. 2A, hypothetical horizontally slatted blind 20 having several slats 22 is shown in an end view in front of a window 24. Blind 20 is open in FIG. 2A, where tilt cords 26, 28 are attached to the ends of the slats 22. Tilt cord 26 is attached to the end of the slats 22 at a point somewhere between the two corners of the slats 22, while tilt cord 28 is attached to the corner of the slats 22 closest to the window 24. When the blind 20 is open, the slats 22 are relatively close to the window 24.

Figure 2B:
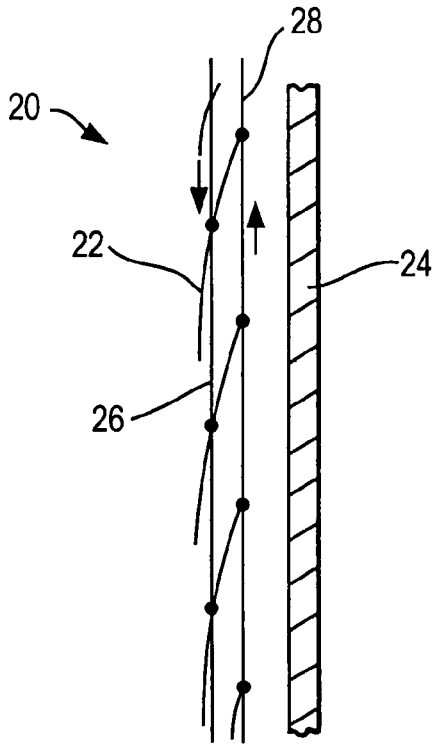
FIG. 2B is an end view of the blind shown in FIG. 2A when closed.

When blind 20 is to be closed, the customarily used mechanism simultaneously lowers tilt cord 26 and raises tilt cord 28, or vice versa, turning each slat 22 about an axis of rotation which is at a point between the tilt cords 26, 28. FIG. 2B, an end view of the slats 22 when the blind 20 has been closed, the tilt cords 26, 28 having been moved in the directions indicated by the arrows, shows that the slats 22 when blind 20 is closed are approximately the same distance from the window 24 as they are when blind 20 is open. In such a situation, light from outside the window is less able to pass into the room from around the ends of the slats 22.

It will be readily apparent to one of ordinary skill in the art, however, that the slats 22 in blind 20 would not be balanced, and would tend to close quickly to the position shown in FIG. 2B if released because a greater portion of the width of each slat 22 is located to the left (in the figure) of the axis of rotation, located between the tilt cords 26, 28, than to the right. As will be discussed in greater detail below, additional weight is added to the right-side (in the figure) edge of each slat, that edge being closer to the window, to act as a counterweight to bring the slats 22 into balance about their geometrically off-centered axes of rotation, allowing them to be set to any desired angle and to remain at any desired angle.

Figure 3:
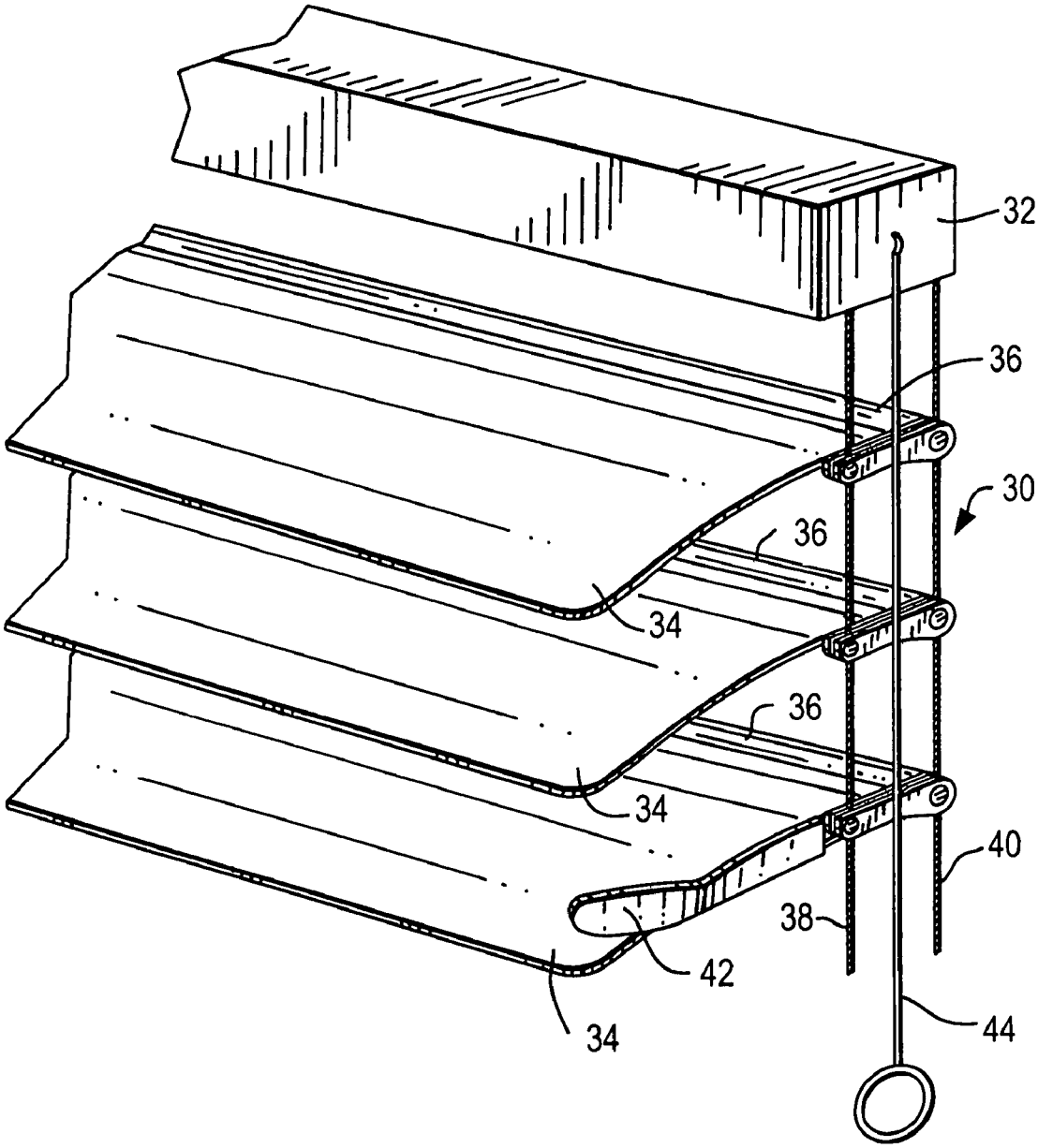
FIG. 3 is a perspective view of the horizontally slatted blind of the present invention.

Turning now more specifically to the present invention, FIG. 3 is a perspective view of the horizontally slatted blind 30 of the present invention. The blind 30 includes a header 32 by which the blind 30 may be mounted onto the top of a window frame. The blind 30 includes a plurality of horizontally extending slats 34, three of which are shown in the figure. A stiffener 36 is attached to the rear edge of each slat 34, the stiffener 36 providing the additional weight, that is, the counterweight, required to balance the slats 34 about axes of rotation located between the tilt cords 38, 40. The stiffener 36 also provides the slat 34 with additional rigidity as may be needed when the window is wide.

Figure 3A:
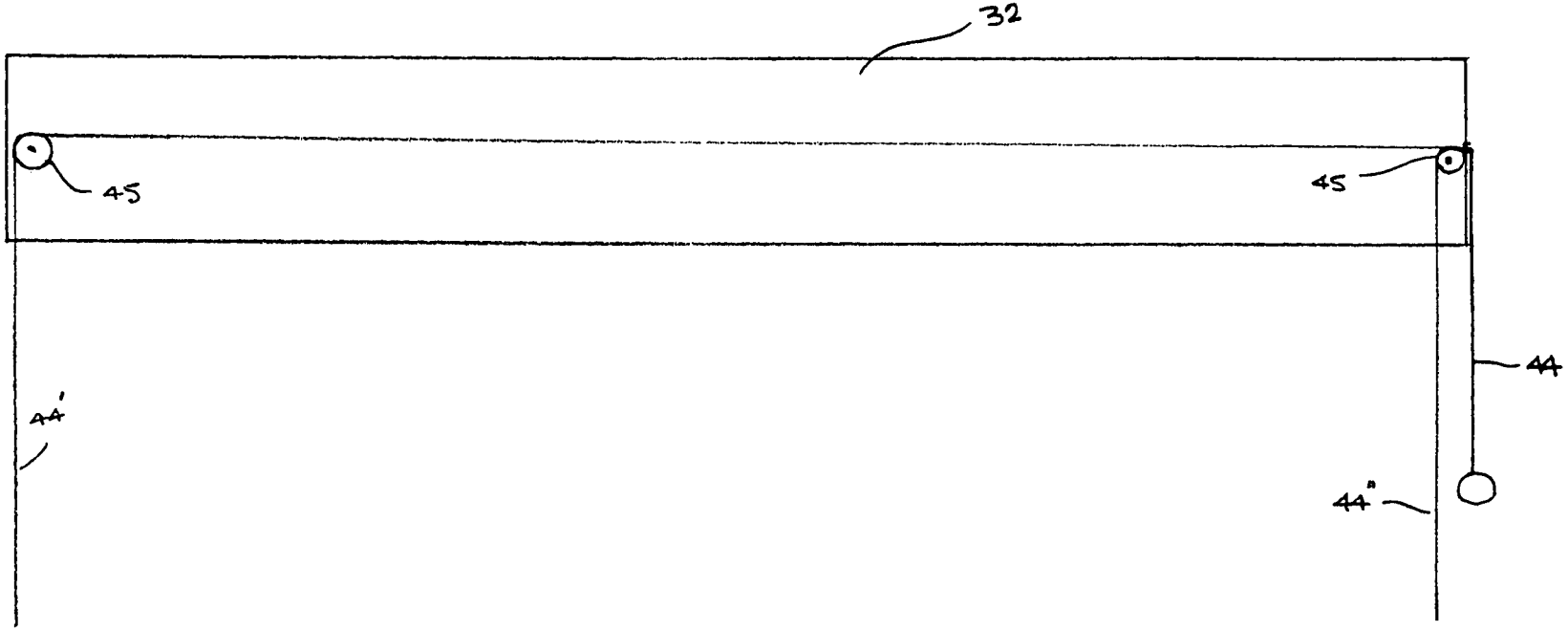
FIG. 3A is a schematic view of the interior of the header of the blind shown in FIG. 3.

As the slats 34 are considerably wider than the header 32 in the present invention, a traditional wand, hanging in front of the slats 34, is not used to adjust the angle thereof to open and close the blind 30. Rather, a handle 42, snapped onto one of the slats 34, is used to make this adjustment manually. A lift cord 44 is provided to enable the blind 30 to be raised and lowered from the bottom. As shown in FIG. 3A, the lift cord 44 passes into the header 32 and over pulleys 45 therein to run as two portions 44',44" down the two opposite ends of the slats 34, in a manner to be shown below in greater detail. The blind 30 of the present invention is intended to run for as close to the entire width of the window in which it is to be used as possible in order to minimize the amount of the light that may be able to leak around its edges into a room.

Figure 4:
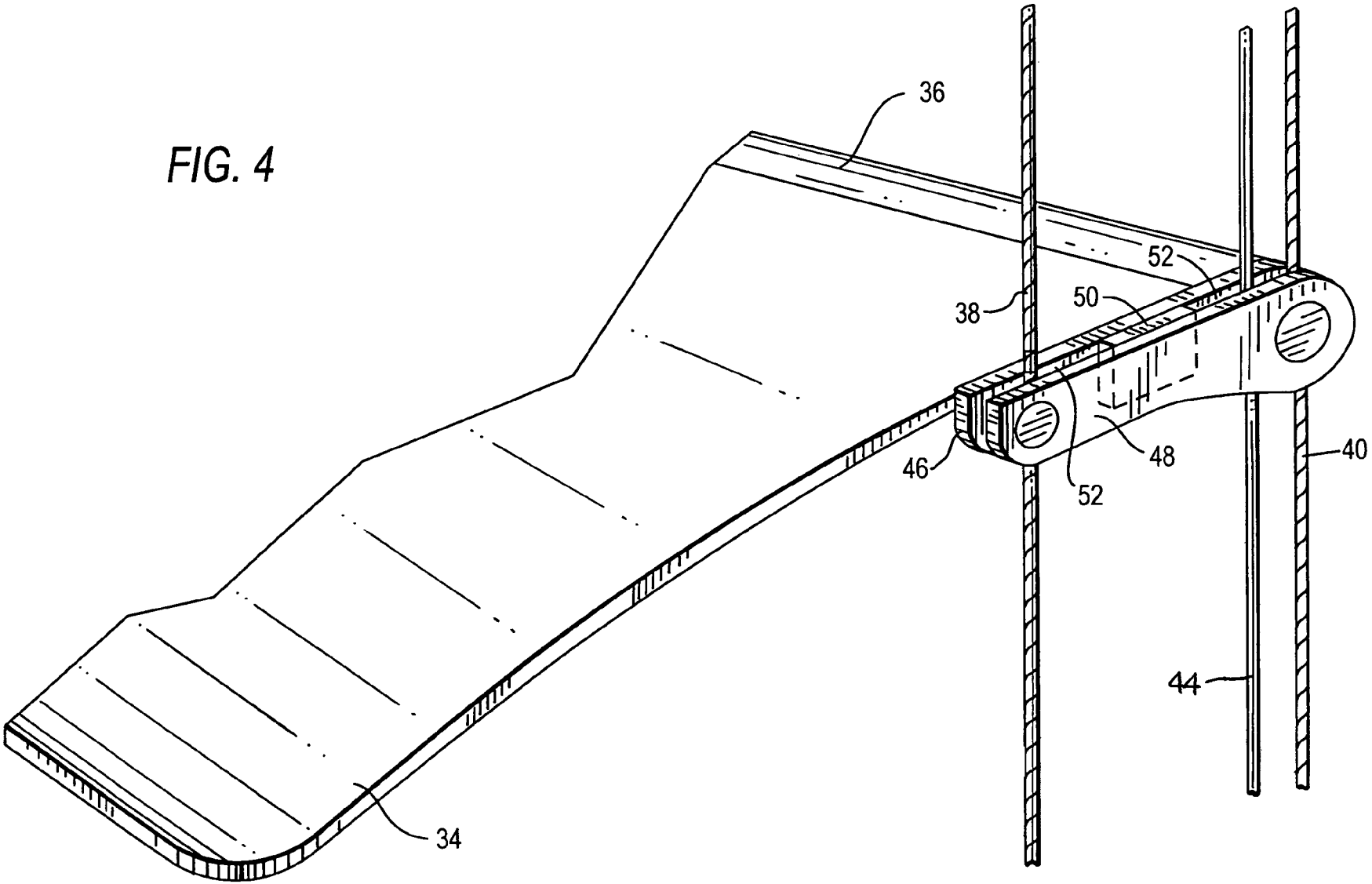
FIG. 4 is a perspective view of the end of one slat of the blind shown in FIG. 3.

FIG. 4 is a perspective view of the end of one slat 34 of the blind 30 shown in FIG. 3. At the end of the slat 34, a first end piece 46 is disposed adjacent to the end of the slat 34 and a second end piece 48 is disposed outwardly from the first end piece 46. A spacer 50 maintains gaps 52 between the first and second end pieces 46, 48. Tilt cords 38, 40 are mounted within gaps 52 in a manner to be shown more clearly in the exploded view to follow. Lift cord 44 also passes through the rearmost gap to enable the slats 34 to be stacked upon one another from below when the blind 30 is raised.

Figure 5:
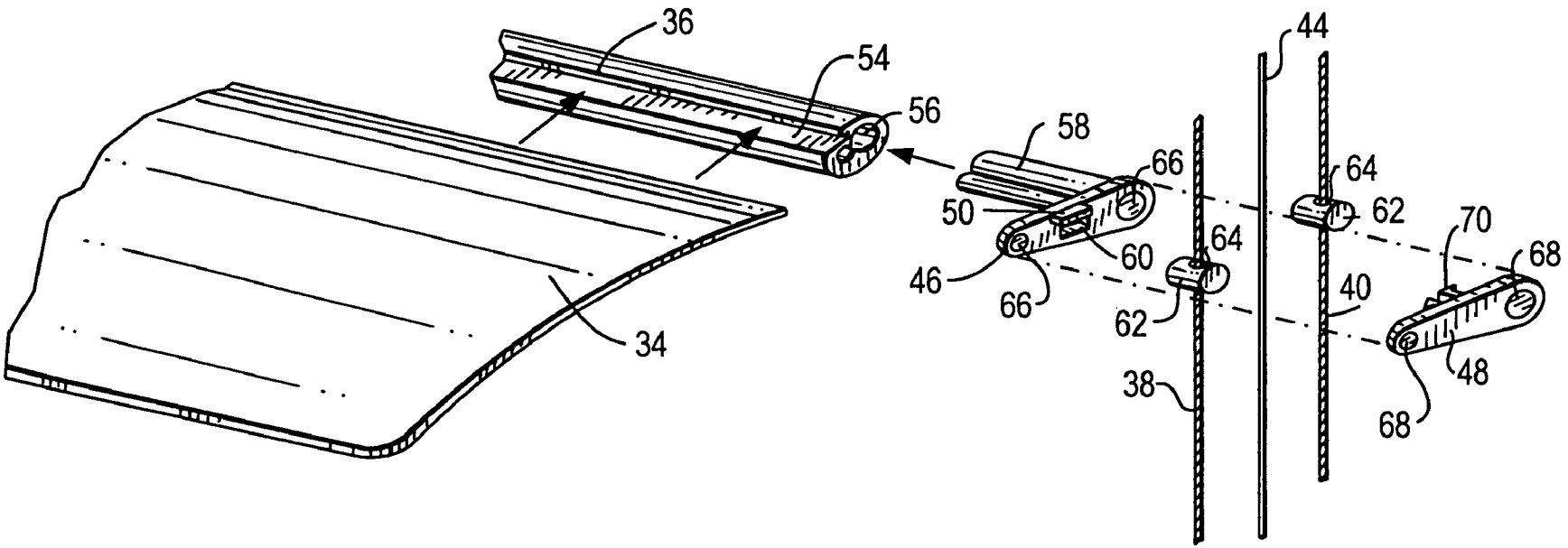
FIG. 5 is an exploded view of the end of the slat shown in FIG. 4.
Figure 5B:
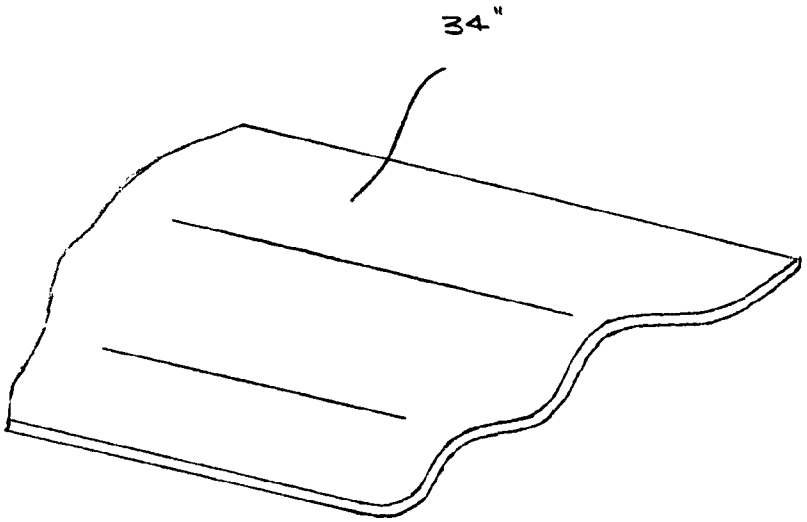
FIG. 5B is a perspective view of an end portion of a sinusoidally undulating slat.
Figure 5A:
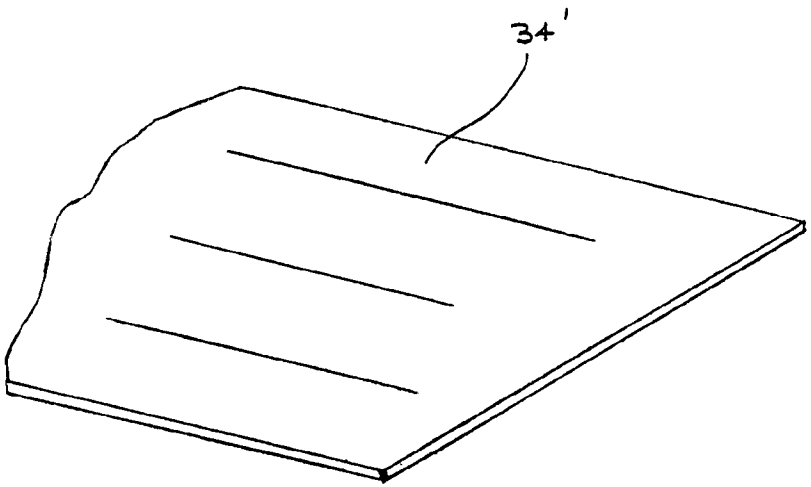
FIG. 5A is a perspective view of an end portion of a flat (planar) slat.

FIG. 5 is an exploded view of the end of slat 34 shown in FIG. 4. Slat 34 may be of plastic, aluminum, plastic with a wooden veneer, stiffened fabric or of any other material used by those of ordinary skill in the art to make slats for Venetian blinds. The slats 34 may be curved, as shown in FIGS. 4 and 5, but they need not be as shown in those figures. For example, they may be flat (planar), like slat 34' in FIG. 5A, or sinusoidally curved, like slat 34" in FIG. 5B, giving them a wavy appearance.

Stiffener 36 may be extruded from plastic or aluminum, or from other suitable materials. Stiffener 36 includes a groove 54 into which slat 34 is inserted. An adhesive may be used to secure the slat 34 within the groove 54. Alternatively, the slat 34 may be held in the groove 54 mechanically with an interference fit.

The stiffener 36 has a central hole 56 running longitudinally therethrough. Additional weight may be inserted therein if required to balance the slat 34, depending on the material from which slat 34 is made.

First end piece 46 has an insert 58 which fits into hole 56 in stiffener 36. Insert 58 may be held in hole 56 with an adhesive or by force fitting. First end piece 46 may have a groove (not shown) into which the end of the slat 34 may fit when first end piece 46 is attached to the stiffener 36, so that slat 34 may be stabilized relative thereto. First end piece 46 may also have a hole 60 for use in connecting second end piece 48 thereto, and is preferably molded from a plastic material.

Tilt cords 38, 40 may be made from plastic monofilament or from braided stainless steel cable. Cylindrical pins 62 are bonded or swedged thereto at appropriate intervals, the tilt cords 38, 40 passing through holes 64 directed transversely therethrough. First end piece 46 has holes 66 into which one end of each cylindrical pin 62 fits.

Second end piece 48 also has holes 68 for the other end of each cylindrical pin 62, and has a snap-lock connector 70 which engages within hole 60 in first end piece 46 to complete the construction. Second end piece 48 is also preferably molded from a plastic material.

Figure 6:
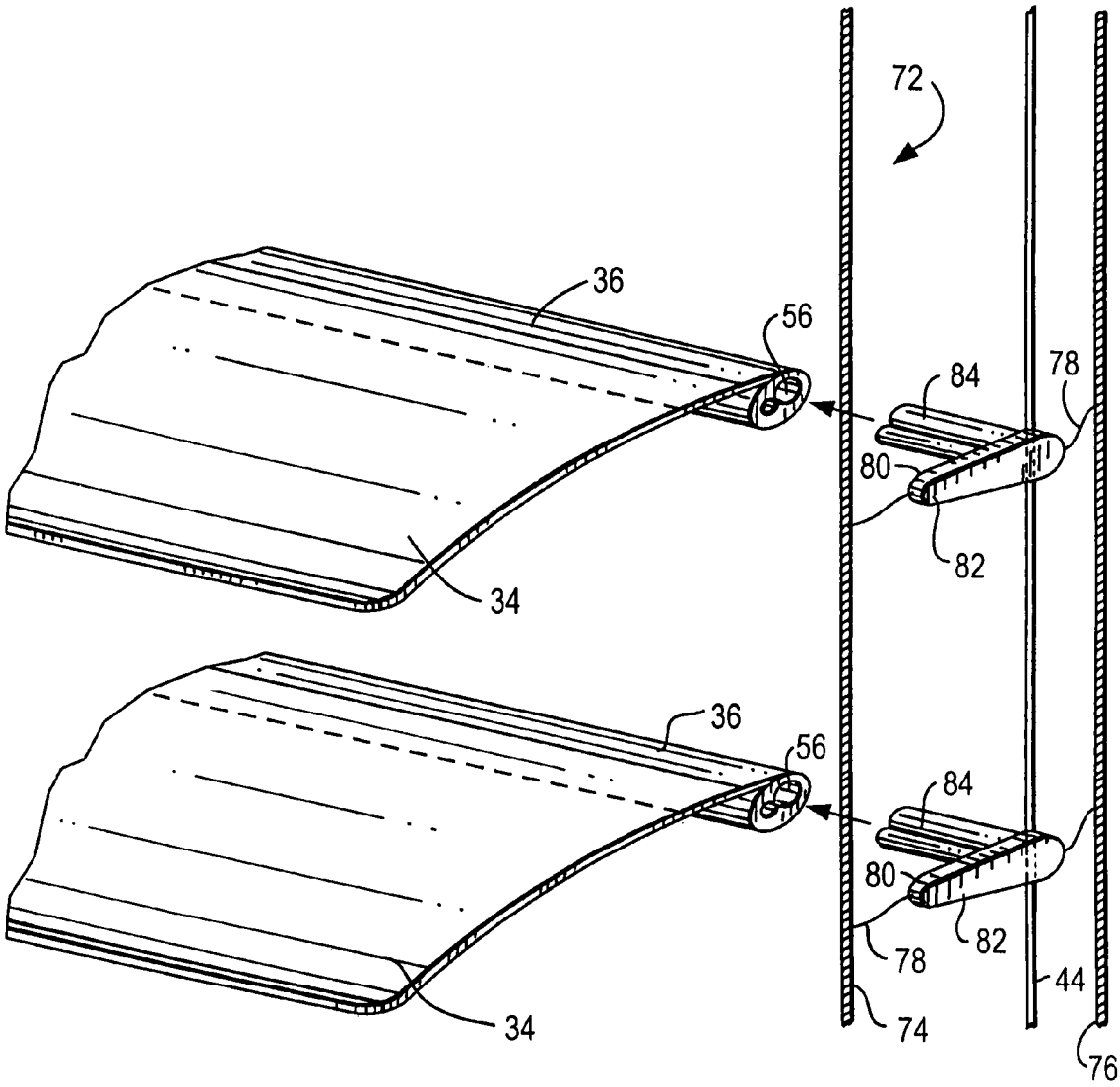
FIG. 6 is a perspective view, partly exploded, of the ends of two slats in an alternate attachment arrangement.
Figure 7:
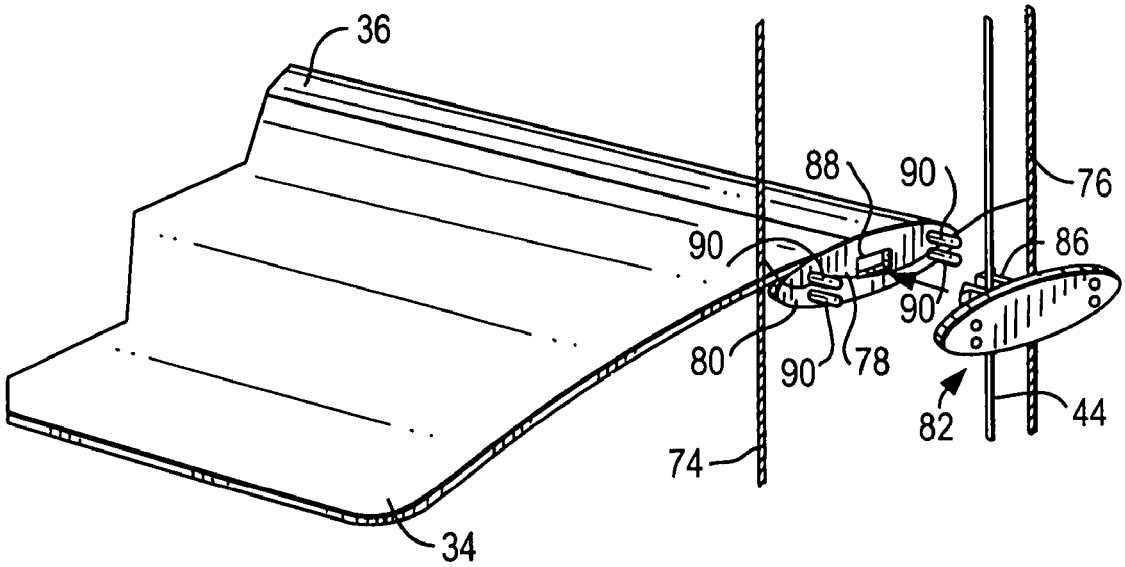
FIG. 7 is a perspective view, also partly exploded, of the end of one slat shown in FIG. 6.

Alternative means for mounting the slats 34 are shown in FIGS. 6 and 7, both of which are exploded perspective views. Referring first to FIG. 6, standard ladder cord 72, comprising tilt cords 74, 76 which are joined at regular intervals by cross cords 78, is used to open and close the blind. Cross cords 78 are enclosed between first end pieces 80 and second end pieces 82, the latter of which being cover caps. As above, first end pieces 80 include inserts 84 which fit into holes 56 in stiffeners 36, and may include a groove (not shown) into which the end of the slat 34 may fit when first end piece 80 is attached to stiffener 36. The lift cord 44 again passes between the first and second end pieces 80, 82.

Referring to FIG. 7, first end piece 80 is shown attached to stiffener 36, but separated from second end piece 82, which includes a snap-lock connector 86 for connecting it to first end piece 80 by engaging in hole 88 in first end piece 80. First and second end pieces 80, 82 may alternatively or additionally be secured to one another by ultrasonic or adhesive bonding.

First end piece 80 also includes several lugs 90, namely, a pair of adjacent lugs 90 at each end of the first end piece 80, so that cross cords 78 may be directed between each pair 80 as to be held in position when the second end piece 82 is secured thereover. In this respect, the lugs 90 act as spacers between the first and second end pieces 80, 82 to provide sufficient clearance for lift cord 44 to pass between them. Both the first and second end pieces 80, 82 are preferably molded from a plastic material.

Figure 8:
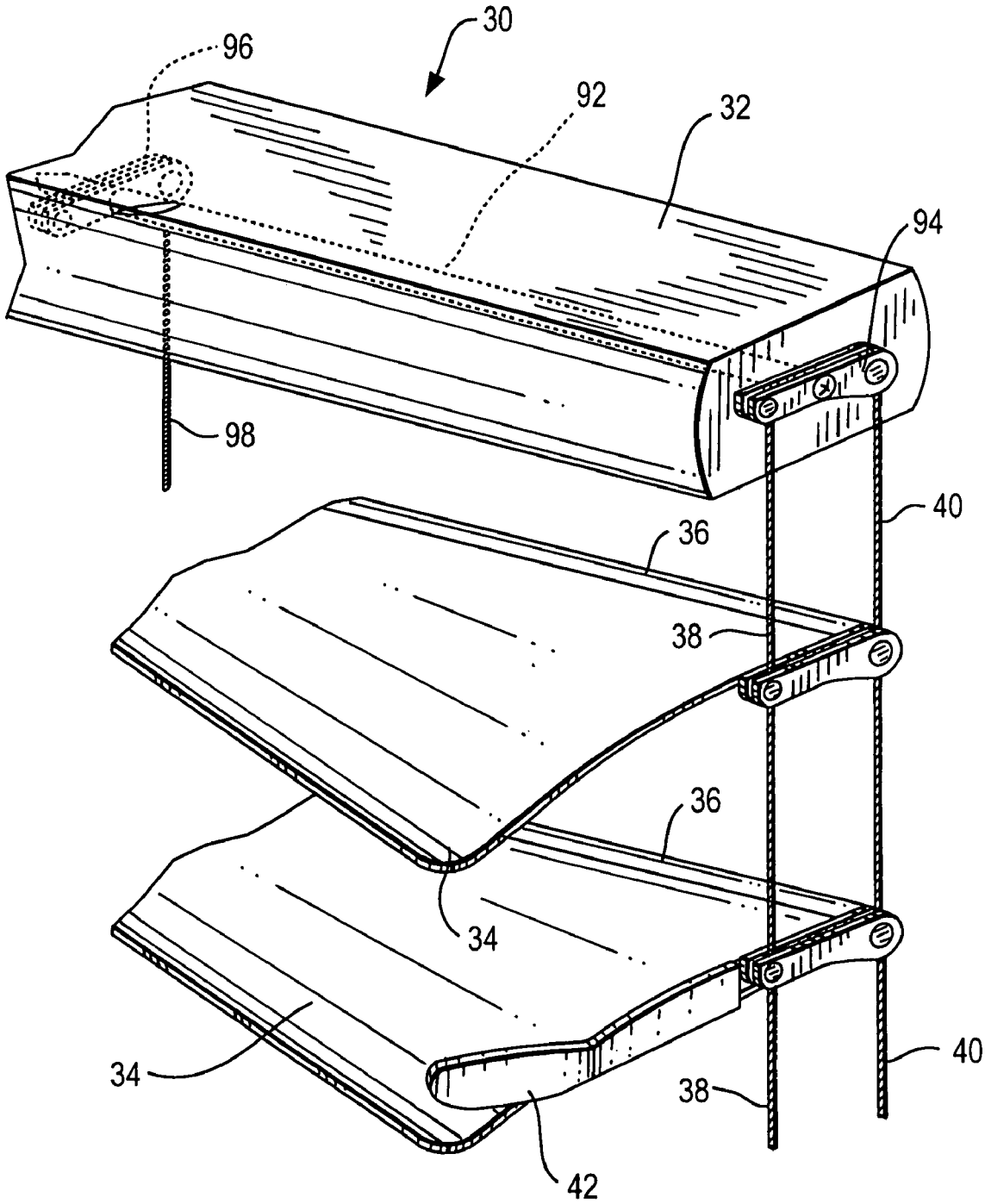
FIG. 8 is a perspective view, analogous to that shown in FIG. 3, illustrating the suspension of the slats in the present horizontally slatted blind.

FIG. 8 is a perspective view, analogous to that shown in FIG. 3, illustrating the manner in which the slats 34 may be suspended from the header 32. Within the header 32 is a rod 92 which runs for the length of the header 32 and substantially for the full width of the blind 30. At each end of the rod 92 is a cross member 94. Tilt cords 38, 40 are attached to opposite ends of the cross member 94. When the blind 30 is to be opened or closed by means of handle 42, tilt cords 38, 40 act on cross member 94 to rotate it about the longitudinal axis of the rod 92, thereby rotating rod 92 and the cross member and the cross member 94 on the far end of the rod 92 to raise or lower the tilt cords 38, 40 at that end, so that the slats 34 may be opened or closed evenly on both ends of the blind 30.

At one or more points between the two ends of the rod 92, an auxiliary cross member 96 may be mounted to turn therewith. Auxiliary cross member 96, oriented generally toward the rear of the slats 34 to which stiffeners 36 are attached, is provided where the blind 30 is wide to suspend one or more center cords 98 down the rear side of the blind 30 and attached to each slat 34 in a manner to be described below to prevent long slats 34 from sagging.

Figure 9:
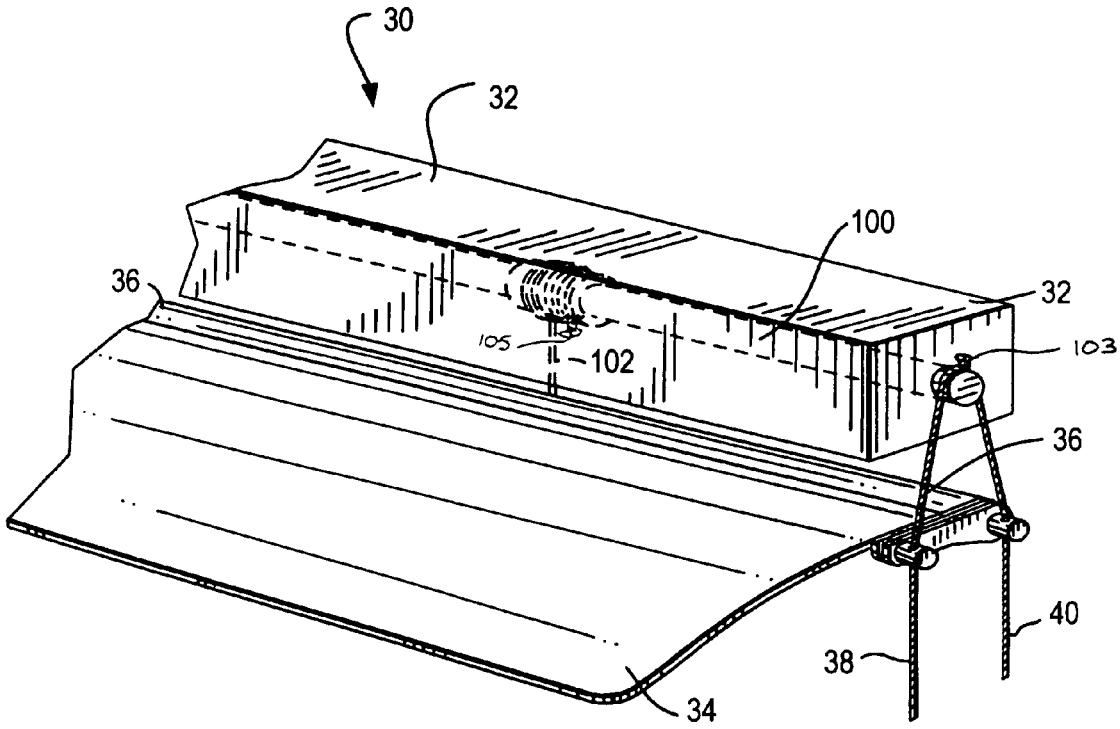
FIG. 9 is a perspective view, analogous to that given in FIG. 8, of an alternate approach for suspending the slats.

An alternate means for suspending the slats 34 from the header 32 is shown in FIG. 9, a perspective view analogous to that provided in FIG. 8. Again, a rod 100 runs for the length of the header 32 and substantially for the full width of the blind 30. Tilt cords 38, 40 are wound around each end of the rod 100 in opposite directions in the manner of a capstan and attached thereto with a set screw 103. When the blind 30 is to be opened or closed, tilt cords 38, 40 at one end of the rod 100 rotate it about its longitudinal axis, which rotation, raises or lowers the tilt cords 38, 40 at the far end of the rod 100 in a corresponding manner, so that the slats 34 may be opened or closed evenly on both ends of the blind 30.

Again, at one or more points between the two ends of the rod 100, center cord 102 may be wound therearound in the same direction as tilt cord 40 and attached thereto by a set screw 105 for attachment to each slat 34 in a manner to be described below to prevent long slats 34 from sagging.

Figure 10:
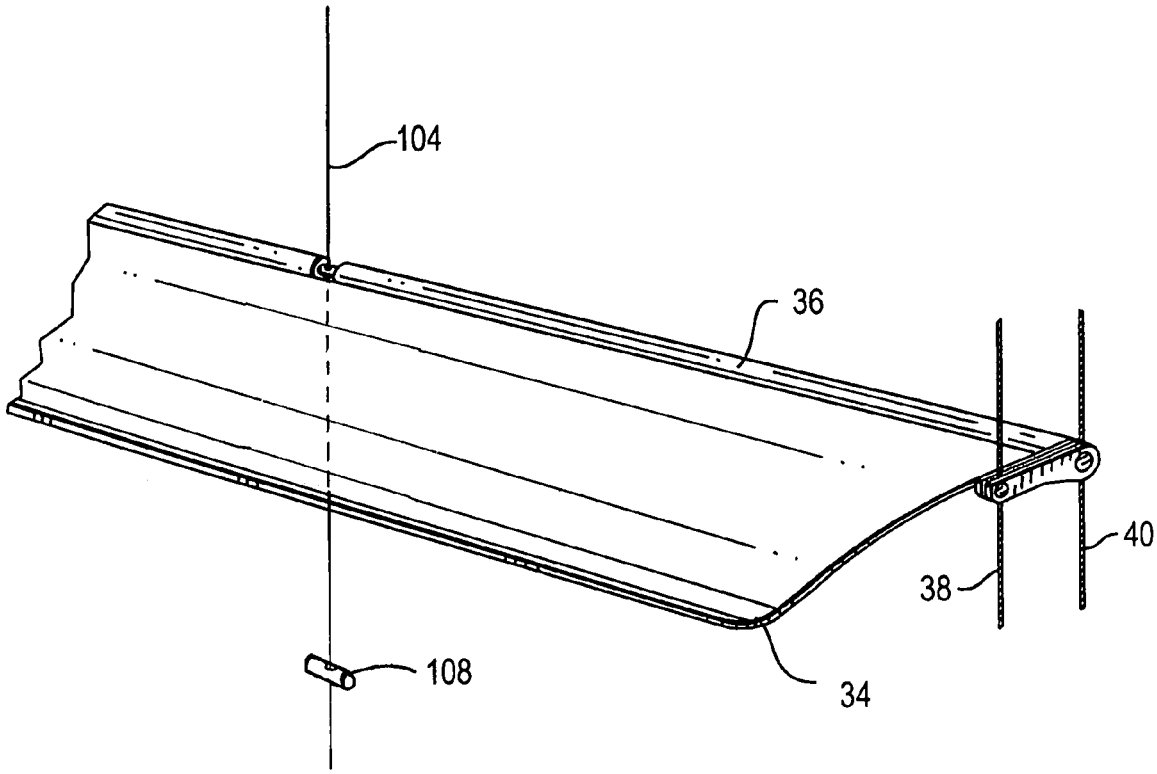
FIGS. 10 and 11 illustrate one means for attaching a center cord to a slat.
Figure 11:
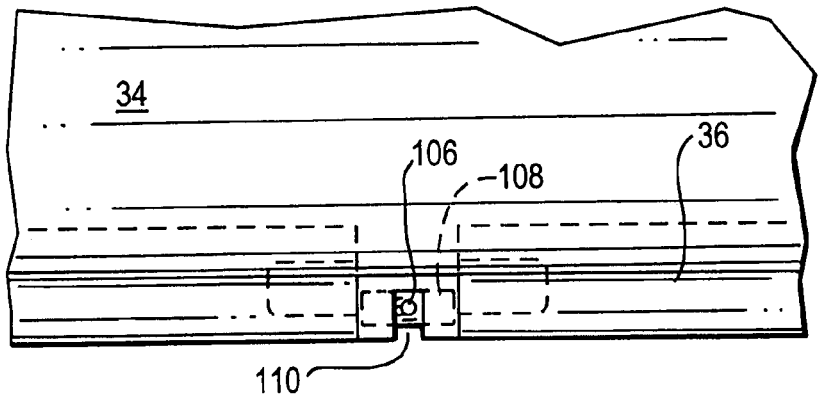

FIGS. 10 and 11 illustrate one approach for connecting a center cord to each slat. Center cord 104 passes at regular intervals through holes 106 transversely directed through cylindrical pins 108, and is bonded or swedged thereto as described above. A notch 110 is provided in the stiffener 36, as well as an opening 112 on its underside to enable the pin 108 to be lodged therein before the slat 34 is inserted into the stiffener 36. Once the slat 34 is so inserted, the pin 108 cannot be removed. Center cord 104 is thereby held within the notches 110 in the stiffeners 36 as illustrated.

Figure 12:
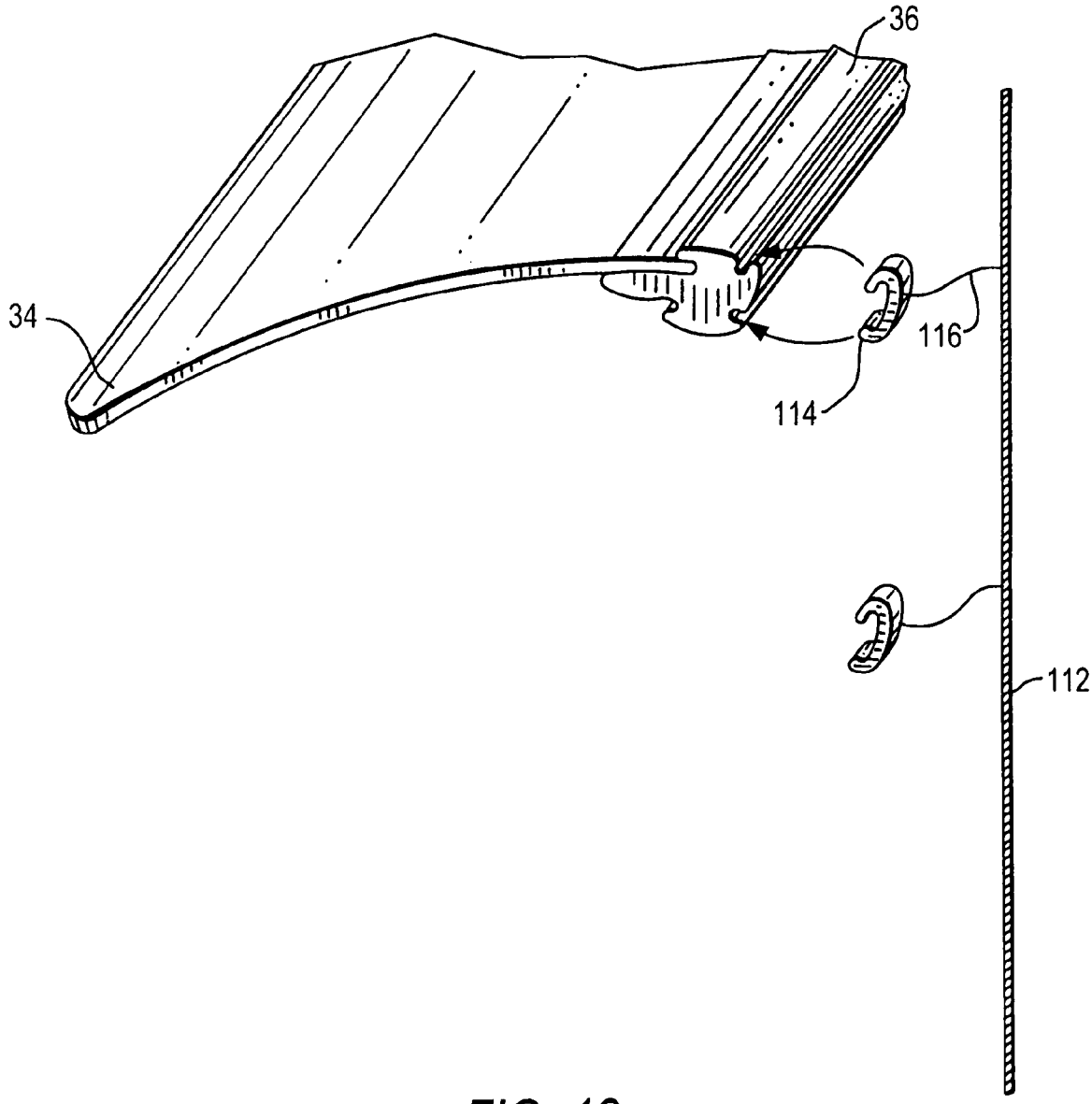
FIG. 12 shows an alternate means for attaching a center cord to a slat.

Alternatively, as shown in FIG. 12, center cord 112 could be obtained by cutting through the cross cords of a standard ladder cord. Clips 114 attached to the severed cross cords 116 may be snapped onto the stiffeners 36 on the slats 34 to provide the required center support for a long slat 34.

Figure 13:
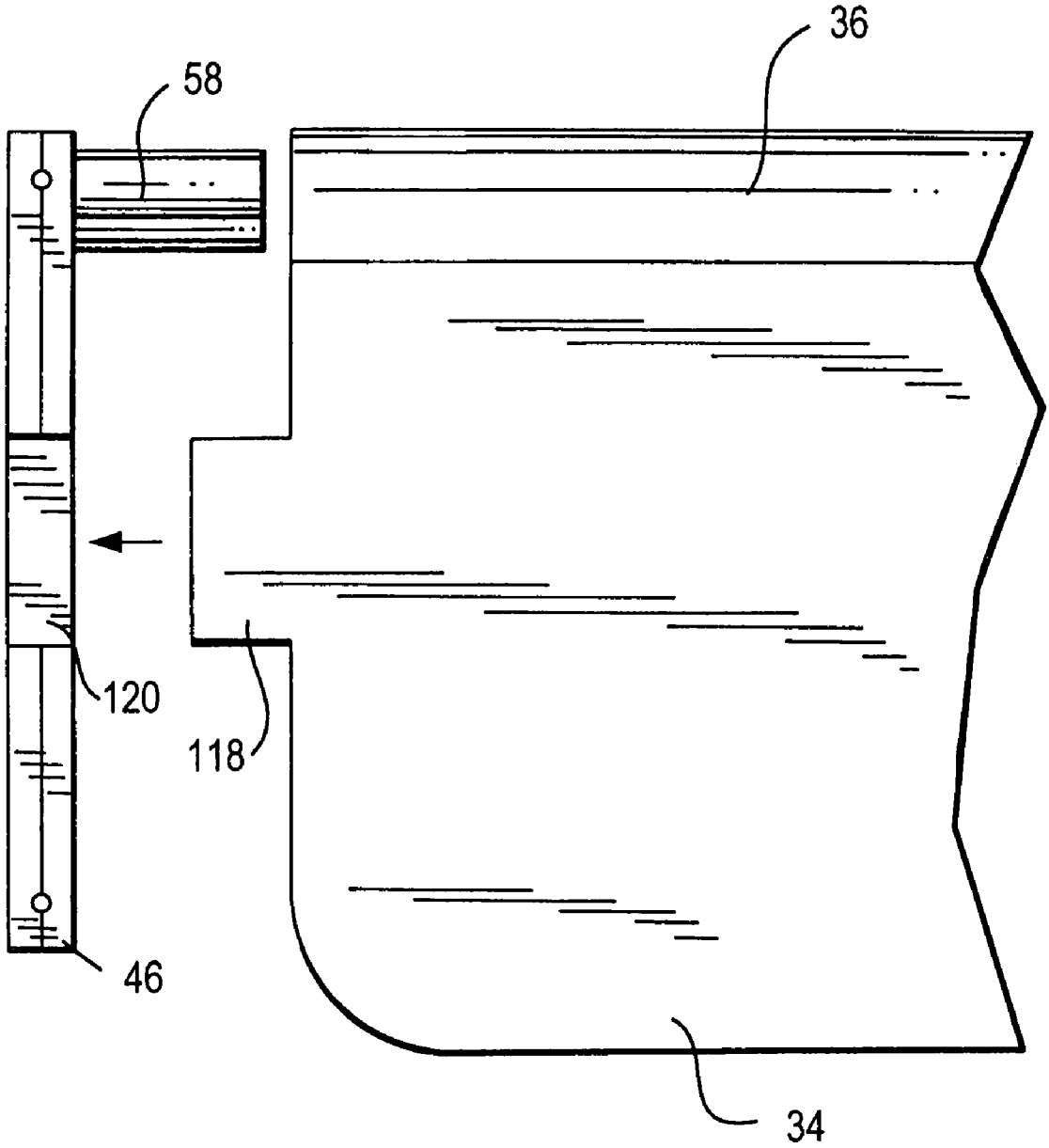
FIG. 13 is an exploded plan view of the end of a slat.

As noted above, grooves may be provided in first end pieces 46, 80 to stabilize slats 34 relative thereto when first end pieces 46, 80 are attached to stiffeners 36. Referring to FIG. 13, an alternate approach for stabilizing the slat 34 is to provide the slat 34 with a tab 118 and first end piece 46, or first end piece 80, with a slot 120 to accommodate tab 118 when first end piece 46 is attached to stiffener 36.

Figure 14:
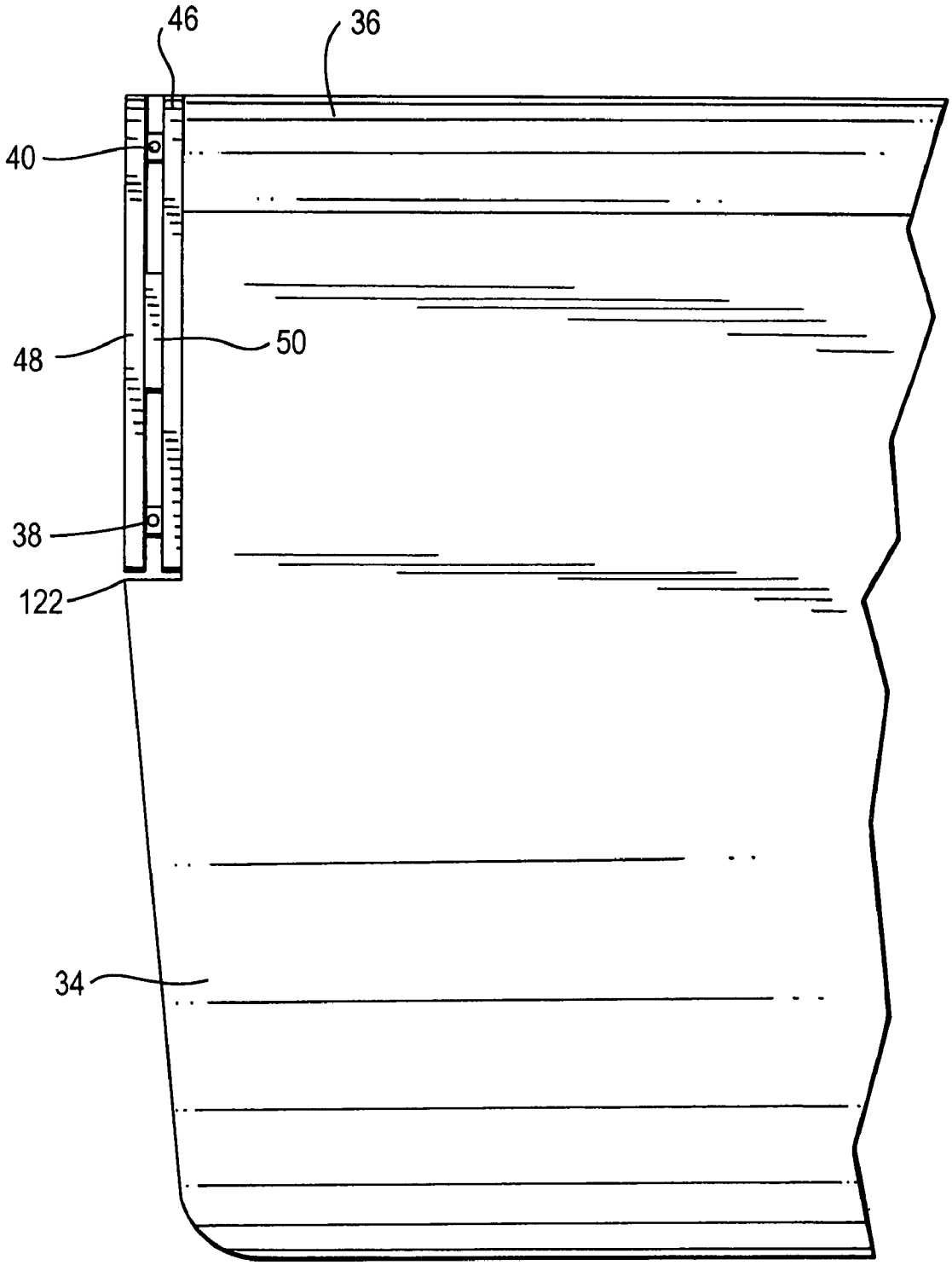
FIG. 14 is another plan view of the end of a slat.

FIG. 14 is a plan view of the end of a slat 34 showing a further optional modification to its shape. Slat 34 is shown as it would appear from above in an open blind 30. First and second end pieces 46, 48 are attached to slat 34 by way of stiffener 36. Slat 34 widens at point 122 at the end of the first and second end pieces 46, 48 by an amount equal to their combined thickness as shown in FIG. 14. As a consequence, when the blind 30 is closed, the slat 34 above that shown will cover the first and second end pieces 46, 48 and hide the tilt cords 38, 40 from view.

Modifications to the above would be obvious to those of ordinary skill in the art but would not bring the invention so modified beyond the scope of the appended claims.

What is claimed is:

1. A horizontally slatted blind comprising:

a header for mounting said blind across an opening;

a rod extending longitudinally within said header and mounted thereto, said rod having a first end and a second end and a longitudinal axis, said rod being rotatable about said longitudinal axis;

a plurality of slats, each said slat having a first end and a second end defining first and second side edges, a front corner at each of said first and second ends and a rear corner at each of said first and second ends, said slats being disposed horizontally and spaced vertically below said header;

a plurality of stiffeners, one stiffener being for each of said plurality of slats, each said stiffener having opposing transverse side edges, each said stiffener longitudinally extending substantially from said rear corner at said first end to said rear corner at said second end of its respective slat, each stiffener preventing slat weight from bending said slat between opposing longitudinal ends of said stiffener;

a first tilt cord and a second tilt cord attached to and extending from each of said first and second ends of said rod;

said slat ends each including a clip, each clip having a front and rear end defining a clip length, each clip front and rear end respectively positioning said first and second tilt cords adjacent to said first and second ends of said slats, said tilt cords not passing through holes in said slats, wherein:

said clip length being greater than a length of said transverse side edges of said stiffener and less than a length of said slat side edges, such that:

said clip front end is disposed substantially forward of said stiffener and substantially rearward of said slat front corner; and said clip front end attaches said first tilt cords to said first and second ends of said slats at points between said front and rear corners;

said clip rear end is disposed at said slat rear corner and attaches said second tilt cords to said first and second ends of said slats substantially at said rear corners; and an axis of rotation for each slat is positioned between said clip front and rear ends, whereby said stiffeners provide a counterweight for balancing said slats about said axis of rotation;

said header having a depth defined by opposing front and rear header surfaces, said header depth being greater than said clip length and being substantially less than said length of said slat side edges; and said blind including means for attaching said first and second tilt cords to said first and second ends of said rod whereby, when said rod is rotated about said longitudinal axis, one of said first and second tilt cords is lowered while the other of said first and second tilt cords is raised by an equal amount, so that said plurality of slats open or close in unison.

2. A horizontally slatted blind as claimed in claim 1 wherein said means for attaching said first and second tilt cords to said first and second ends of said rod is a cross member at each of said first and second ends of said rod, each of said cross members having a first and a second end, said first tilt cords being attached to said first ends of said cross members and said second tilt cords being attached to said second ends of said cross members.

3. A horizontally slatted blind as claimed in claim 1 wherein said means for attaching said first and second tilt cords to said first and second ends of said rod is a set screw at each of said first and second ends of said rod, said first tilt cords being wound around said rod in one direction and secured to said set screw and said second tilt cords being wound around said rod in the opposite direction and secured to said set screw.

4. A horizontally slatted blind as claimed in claim 1 wherein said slats are made of a material selected from the group consisting of plastic, aluminum, stiffened fabric and wood.

5. A horizontally slatted blind as claimed in claimed 1 wherein said slats are of plastic with a wooden veneer.

6. A horizontally slatted blind as claimed in claim 1 wherein said slats have a curved shape.

7. A horizontally slatted blind as claimed in claim 1 wherein said slats are planar.

8. A horizontally slatted blind as claimed in claim 1 wherein said slats have a sinusoidally undulating shape.

9. A horizontally slatted blind as claimed in claim 1 further comprising a handle, said handle being attached to one of said slats for manually opening and closing said blind.

10. A horizontally slatted blind as claimed in claim 1 further comprising a lift cord, said lift cord having a first portion running adjacent to said first ends of said plurality of slats from said header to a bottommost of said slats and a second portion running adjacent to said second ends of said plurality of slats from said header to said bottommost of said slats, said first and second portions of said lift cord passing upward into said header and over pulleys therein to join with one another adjacent to one of said first and second ends of said rod so that said blind may be raised from said bottommost of said slats by pulling on said lift cord.

11. A horizontally slatted blind as claimed in claim 1 wherein said stiffeners are extruded from a material selected from the group consisting of plastic and aluminum.

12. A horizontally slatted blind as claimed in claim 1 wherein said stiffeners have grooves running longitudinally therealong, said slats being inserted in said grooves to attach said stiffeners to said slats.

13. A horizontally slatted blind as claimed in claim 12 wherein said slats are held in said grooves with an adhesive.

14. A horizontally slatted blind as claimed in claim 13 wherein said slats are held in said grooves with an interference fit.

15. A horizontally slatted blind as claimed in claim 1 wherein said stiffeners have central holes running longitudinally therethrough for additional weight to balance said slats.

16. A horizontally slatted blind as claimed in claim 1 wherein said first and second tilt cords are attached to said first and second ends of said slats by first and second end pieces at each of said ends, said first end pieces being attached to said stiffeners at said first and second ends and said second end pieces being attached to said first end pieces, said first and second tilt cords being held between said first and second end pieces.

17. A horizontally slatted blind as claimed in claim 16 wherein said first and second end pieces are molded from a plastic material.

18. A horizontally slatted blind as claimed in claim 16 wherein said first end pieces have inserts and said stiffeners have central holes, whereby said inserts are inserted into said central holes to attach said first end pieces to said stiffeners.

19. A horizontally slatted blind as claimed in claim 16 wherein said first end pieces include slots and said slats include tabs, whereby said tabs fit into said slots when said first end pieces are attached to said first and second ends of said slats to stabilize said slats relative to said first end pieces.

20. A horizontally slatted blind as claimed in claim 16 wherein said first end pieces include grooves, whereby said slats fit into said grooves when said first end pieces are attached to said first and second ends of said slats to stabilize said slats relative to said first end pieces.

21. A horizontally slatted blind as claimed in claim 16 wherein said first and second end pieces each have a first hole and a second hole, said first holes and said second holes facing one another when said second end pieces are attached to said first end pieces, and wherein said first and second tilt cords have cylindrical pins disposed thereon at intervals, said cylindrical pins being disposed in said facing first and second holes when said second end pieces are attached to said first end pieces, thereby attaching said first and second tilt cords to said first and second ends of said slats.

22. A horizontally slatted blind as claimed in claim 16 wherein said first end pieces have two pairs of adjacent lugs and wherein said first and second tilt cords are joined at intervals by cross cords, said cross cords being disposed between said pairs of lugs on said first end pieces and being held therein when said second end pieces are attached to said first end pieces, thereby attaching said first and second tilt cords to said first and second ends of said slats.

23. A horizontally slatted blind as claimed in claim 1 further comprising a center cord, said center cord being attached to each of said slats at points on said stiffeners between said first and second ends of said slats, said center cord further being attached to said rod; and means for attaching said center cord to said rod between said first and second ends thereof whereby, when said rod is rotated about said longitudinal axis, said center cord is moved in the same direction as said second tilt cord, said center cord being provided to prevent said slats from sagging.

24. A horizontally slatted blind as claimed in claim 23 wherein said means for attaching said center cord to said rod is an auxiliary cross member, said center cord being attached to said auxiliary cross member.

25. A horizontally slatted blind as claimed in claim 23 wherein said means for attaching said center cord to said rod is a set screw, said center cord being wound around said rod in the same direction as said second tilt cord and secured to said set screw.

26. A horizontally slatted blind as claimed in claim 23 wherein said center cord is attached to said stiffeners with clips.

27. A horizontally slatted blind as claimed in claim 23 wherein said center cord has cylindrical pins attached thereto at intervals and said stiffeners are provided with notches within which said pins are disposed to attach said center cord to said stiffeners.

28. A horizontally slatted blind as claimed in claim 1 wherein a distance between said first and second ends of said slats, defining a width of said slats, is greater between said front corners and said points where said first tilt cords are attached than between said points and said rear corners, so that said slats cover said first and second tilt cords when said blind is closed.

* * * * *